US006540180B2

(12) United States Patent
Anderson

(10) Patent No.: US 6,540,180 B2
(45) Date of Patent: Apr. 1, 2003

(54) METHOD AND APPARATUS FOR DETECTING MISALIGNED TRACKS

(75) Inventor: Theodore R. Anderson, Galway, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/832,087

(22) Filed: Apr. 11, 2001

(65) Prior Publication Data

US 2002/0148931 A1 Oct. 17, 2002

(51) Int. Cl.[7] ..... B61L 23/04

(52) U.S. Cl. ..... 246/120
(58) Field of Search ..... 246/121, 120

(56) References Cited

U.S. PATENT DOCUMENTS

| | | | | |
|---|---|---|---|---|
| 3,696,243 A | * | 10/1972 | Risely | 246/121 |
| 5,397,083 A | * | 3/1995 | Thomas | 246/121 |
| 5,713,540 A | * | 2/1998 | Gerszberg et al. | 246/121 |
| 6,102,340 A | * | 8/2000 | Peck et al. | 246/121 |

* cited by examiner

*Primary Examiner*—S. Joseph Morano
*Assistant Examiner*—Robert J. McCarry, Jr.
(74) *Attorney, Agent, or Firm*—James M. Kasischke; Michael J. McGowan; Michael F. Oglo

(57) ABSTRACT

A warning system for identifying a track misalignment. An RF generator and horn antenna direct energy onto a track rail that acts as a traveling wave antenna. An antenna near a potential discontinuity radiates RF energy, the amount of energy radiated being related to the amount of misalignment in the track. If radiated energy exceeds a certain threshold, a receiver energizes an alarm that announces a misalignment.

20 Claims, 2 Drawing Sheets

METHOD AND APPARATUS FOR DETECTING MISALIGNED TRACKS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to warning and alarm systems and more particularly to railway warning and alarm systems that can detect a railroad track misalignment.

(2) Description of the Prior Art

Various alarm systems have been proposed for detecting a number of conditions in a railroad system including broken tracks, train collisions and other faults. For example, U.S. Pat. No. 3,696,243 (1972) to Risley discloses a broken rail detector in which a transmitter provides coded pulses to a relay. The relay, intermittently and according to the code, applies electrical energy to each track at different polarities. A receiver receives the coded energy at a position remote from the transmitter. Any change in the received code indicates to the transmitter that some change in track characteristics has occurred.

U.S. Pat. No. 4,207,569 (1980) to Meyer discloses a railroad radio frequency waveguide for conducting radio frequency signals ahead of a train and along a railroad line comprising the ballast, ties and rails. Reflections received by a receiver on the train represent changes in the characteristics impedance of the waveguide. These reflections may be compared to anticipated reflections in order to detect improper conditions such as a broken track or the presence of another train.

U.S. Pat. No. 4,306,694 (1981) to Kuhn discloses a dual signal frequency motion monitor and broken rail detector. A highway crossing warning system for monitoring the motion and predicting the time of arrival of an approaching train at the highway crossing and for detecting the presence of a broken rail in the approach zone is acheived by feeding dual frequency signals into the track rails and measuring the track impedances at the two frequencies and the phase angle of the lower of the two frequencies.

U.S. Pat. No. 4,886,226 (1989) to Frielinghaus discloses a broken rail and/or broken rail joint bar detection system. This system detects rail breaks in dark territory track sections, i.e., track sections that do not have a signaling system. A communications link may exist between the ends of the track sections.

U.S. Pat. No. 4,932,618 (1990) to Davenport et al. discloses a sonic track condition determination system. Sonic transponders mount on a train and the track upon which it rolls and transmit and receive sonic vibrations along the track. Information currently being transmitted electrically may also be transmitted sonically. Since the track interferes with the sonic vibrations more than it does with an electrical signal, the condition of the track may also be determined. Specifically, this invention utilizes six steps including (1) impressing a first sonic vibration in a predetermined form on the track at the train, (2) receiving the first sonic vibration from the track at the point on the track distant from the train, (3) impressing a second sonic vibration, in a predetermined form, on the track at the point of the track distant from the train, (4) receiving the second sonic vibration from the track at the train, (5) comparing the first or second sonic vibration as received with the corresponding sonic vibration as predetermined, and (6) converting the comparison of the vibration as received with the corresponding vibration as predetermined into a determination of the condition of the track between the train and the point on the track distant from the train.

U.S. Pat. No. 4,979,392 (1990) to Guinon discloses a railroad track detector that mounts on a track vehicle and uses the track ahead or behind the vehicle as a transmission line for a high frequency signal. The transmission line has a known characteristic impedance and a condition of no track fault. The impedance is included in a bridge network that is excited with the high frequency signal. Bridge imbalance indicates a track fault that can be a complete or partial short circuit or open circuit. The bridge excitation is applied to the track through moving contacts, like brushes, ahead of the front wheels or behind the last wheels. The shunt effect of the wheels close to the brushes is eliminated by a tuning impedance that creates an effective infinite impedance to the portion of the track between the moving contacts and the shunting wheels.

U.S. Pat. No. 5,713,540 (1989) to Gerszberg et al. discloses a method and apparatus for detecting railway activity by means of a highly reliable, early warning system that can provide efficient detection of railway activity in which an acoustic sensor circuit coupled to the railway detects sound waves resulting from physical vibrations on the tracks. An acoustic analysis of the detected sound waves identifies any suspect conditions and generates an alarm signal accordingly. An acoustic signal processing unit stores detected sound waves in a sound file for quick retrieval and analysis. The alarm signal may be transmitted over any communications system to the central control office and to trains traveling on the dangerous track. The stored sound files may be locally retrieved or downloaded to a remote location over a cellular system thus enabling the analysis of the actual sound generated by the dangerous condition to determine the cause therefore.

Generally speaking, the foregoing references can be categorized as suggesting the detection of an imbalance in the electrical characteristic of two rails. The Meyer patent also discloses the concept of using an imbalance to signal a fault. Each of these systems, however, requires reasonably expensive installations particularly requiring equipment at various sites. Moreover, these patents disclose systems that will detect major faults, as a broken track. However, there are a number of situations in which mere misalignment of a track may cause a derailment. Such misalignments can often occur at bridges, for example, where the tracks on the bridge span may be swung out of position or moved out of alignment with the tracks on land. It is important when the bridge is closed that the tracks exactly align in both the horizontal and vertical orientations. None of these references appears to disclose or suggest any modality that is sufficiently sensitive to detect any such misalignment. What is needed is a system that can be used to detect such misalignments and can be easily installed in the vicinity of a track subject to such a misalignment, as at any bridge.

SUMMARY OF THE INVENTION

Therefore it is an object of this invention to provide a method and apparatus for detecting track misalignments.

Another object of this invention is to provide a method and apparatus for detecting track misalignments that is efficient to operate.

In accordance with one aspect of this invention, the detection of a railroad track misalignment in a predetermined track area includes directing RF energy to a proximally positioned rail remotely from the predetermined track area whereby the track acts as a traveling wave antenna. The RF signal is then detected at a remote site proximate the site of the potential misalignment. An alarm responds to the level of the received signal when the received signal exceeds a predetermined value.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
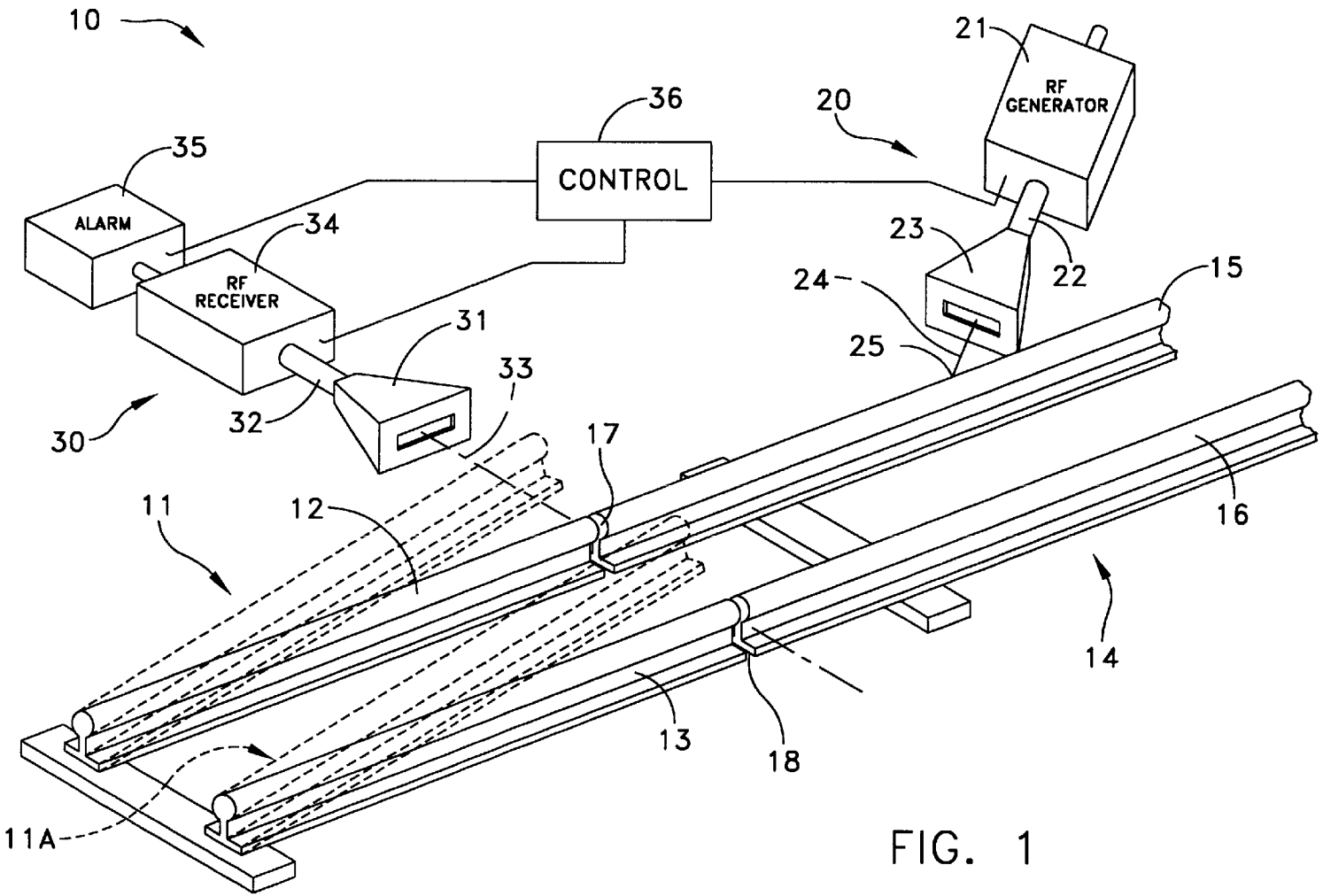
FIG. 1 is a block diagram in perspective form of an area of a railroad track that includes detection apparatus constructed in accordance with this invention.

FIG. 1 depicts an apparatus for detecting railroad track misalignment 10, including one track section 11 that forms a part of a drawbridge, or the like, with fixed track rails 12 and 13 and a section of track 14 with track rails 15 and 16 permanently affixed to the ground. As depicted by the dashed lines, the track section 11 can be pivoted or otherwise displaced to a position 11A out of alignment with the track section 14. FIG. 1 depicts a representative cross tie with each track section.

Figure 2:
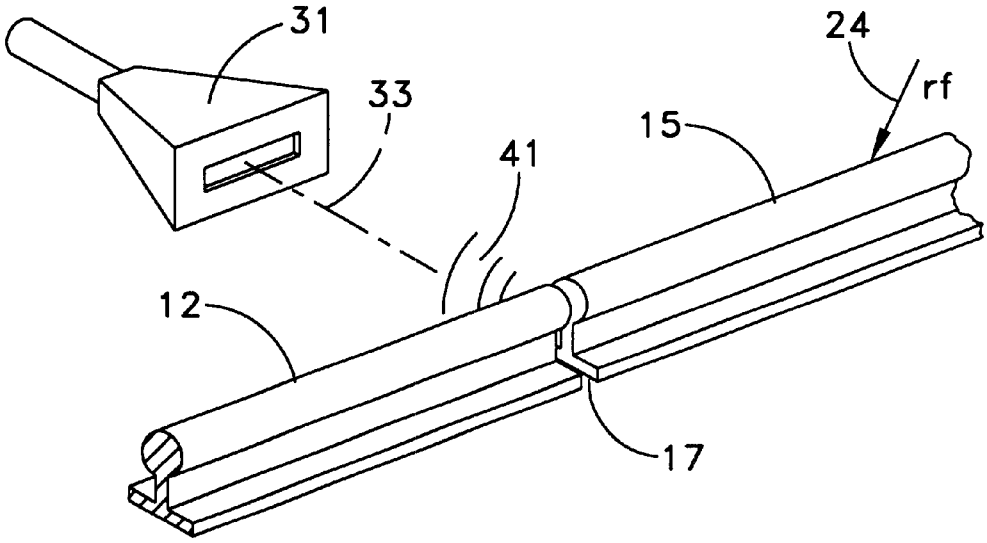
FIG. 2 is a diagram of two sections of a rail in alignment.
Figure 3:
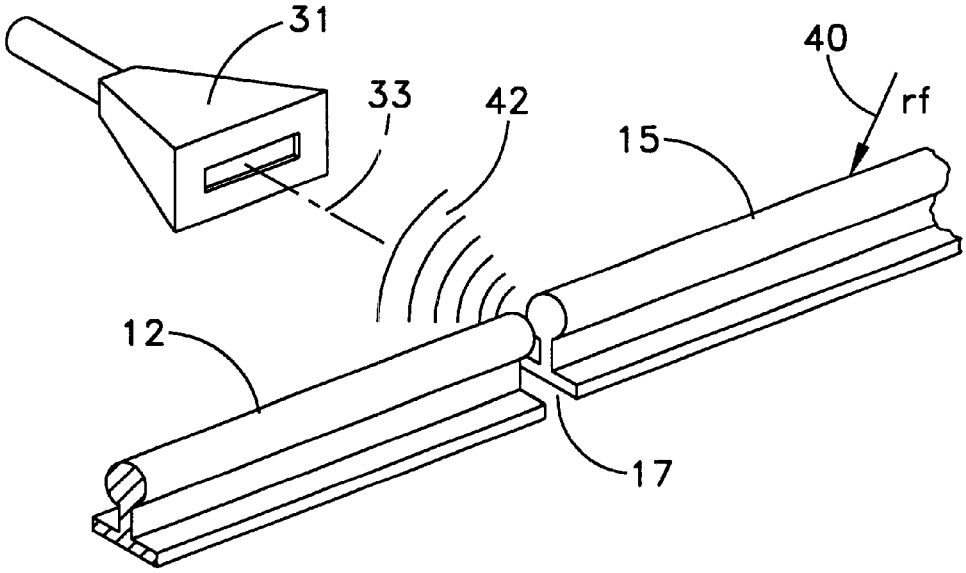
FIG. 3 is a perspective view of two rails in misalignment.

As shown in FIGS. 1 and 2, when the track rails 12 and 15 of the sections 11 and 14 are aligned, the surfaces of the track 12 essentially constitute an extension or continuation of the surfaces of the track rail 15. There is a small gap between the track rails 12 and 15, but essentially the surfaces of the adjacent tracks as shown by the gaps 17 and 18 in FIG. 1 remain aligned. FIG. 3 depicts a misalignment whereby the track rail 12 is depressed and slightly to the left of track rail 15. Now there is a significant discontinuity at 17 because the extensions of the surfaces of the track rail 15 intersect the end of the track rail 12 at the gap 17.

Referring again to FIG. 1, apparatus 10 senses any variation in the gap caused by a track misalignment as shown in FIG. 3. Specifically, an RF transmitter 20 includes an RF generator 21, a waveguide 22 and a horn antenna 23. The horn antenna 23 directs RF energy along a transmission axis 24 to intercept the track rail 15 at a location 25 that is spaced from the predetermined area of the gaps 17 and 18. In this particular embodiment the RF transmitter 20 is proximate the fixed track section 14 but spaced from the track rail 15. When the generator 21 produces an RF energy, that energy moves along the axis 24 and intercepts the track rail 15 where the electromagnetic wave from the horn antenna 23 becomes a traveling wave that travels along the track rail 15, so the track rail acts as a traveling wave antenna.

An RF detector 30 includes a horn antenna 31 positioned proximate the track rails 12 and 15 and aimed at the gap 17. A waveguide 32 directs RF energy received by the horn antenna 31 along the axis 33 into a receiver 34. When the receiver 34 receives a signal of sufficient strength, it energizes an alarm 35. If the track rails 12 and 15 are in alignment, a minimal surface discontinuity exists at the gap 17. Thus as shown in FIG. 2, only minimal RF energy 41 radiates from the gap 17. The alarm 35 will be set so that the output from the receiver 34 will not sound an alarm at such an output magnitude.

When however the track rail 15 and track rail 12 are not in alignment, as shown in FIG. 3, there is no continuity of the surfaces at the gap 17. The resulting discontinuity causes a greater level of RF energy 42 to radiate from the discontinuity. When this occurs, the RF signal intercepted by the horn antenna 31 and sent to the receiver 34 along the axis 33 and through the waveguide 32 produces a larger signal that exceeds a predetermined value or threshold so the alarm 35 announces the misalignment.

The RF transmitter 20 and RF detector 30 can operate at any of a wide range of RF frequencies. For a specific implementation, a selected frequency could be up to about 60 GHz. The selection will depend upon a number of factors, such as desired measurement accuracy, as known in the art.

Each horn antenna will be spaced from the rail, preferably within a few wavelengths of the rail to minimize power dissipation. Generally the physical characteristics of the environment will be determinative of specific spacing for an application.

FIG. 1 also depicts a control circuit 36 that connects to the RF generator 21, the RF receiver 34 and alarm 35. In one embodiment the control 36 could schedule tests on a time or event basis. A scheduled train arrival time would be an example of a time basis; a bridge closure, an event basis. The test sequence could be defined with the steps of energizing circuits, waiting for a warm-up interval, conducting an active test and then shutting the system down. As will be apparent, the control 36 could be local or remote and could perform any of a variety of additional or alternative functions.

There are many possible implementations of this invention. The entire system could operate continuously or intermittently. For example, part of the bridge closure process could include energizing the RF transmitter 20 and RF detector 30 thereby to check the alignment of tracks immediately after each closure. In FIG. 2 the RF transmitter 20 transfers data onto a track 15 on land. The RF transmitter 20 could also be placed on the bridge with the RF energy being coupled onto the rail 12. In either case the rails 12 and 15 will act as a traveling wave antenna.

Further, the embodiment of FIG. 1 is depicted on a dual railroad track. It is understood that the apparatus 10 can be used on any single or multiple rail system where the rail can act as a traveling wave antenna.

FIG. 1 depicts an embodiment of this invention in which the process is directed to the rails 12 and 15. In the alternative, the rails 13 and 16 would be tested. Any such single rail, of course, assumes that the rails on the movable span remain exactly parallel and that there is no possibility of any misalignment of the non-tested rail. If that assumption is not correct, a dual system can be used to test both tracks simultaneously. Such a dual system might incorporate independent RF transmitters and detectors or a single RF transmitter with a single or double RF detector arrangement.

FIG. 1 also depicts a system in which the transmitting axis 24 is at about 45° to the track rail 15 while the receiving axis 33 is at about 90° to the tracks rails 12 and 15 at the gap 17. These are representative angles only. In different installations the operating parameters and physical constraints on equipment location might result in other angular relationships.

This application has disclosed a system with various components at a block level. It will be apparent such elements for generating a specific design frequency will be produced by conventional means without additional inventive input. That is, the design and construction of such components is well within the abilities of the persons of ordinary skill in the art.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A system for detecting a track discontinuity in a predetermined track area comprising:

RF transmitting means for directing RF energy onto a proximately positioned track rail that is remote from the predetermined track area whereby the track rail acts as a traveling wave antenna for conveying the RF energy to the predetermined track area;

RF detecting means positioned proximate the predetermined track area for generating an output signal in response to RF energy emanating from the track rail at the predetermined track area; and alarm means responsive to the output of said RF receiving means for generating an alarm when the RF energy emanating from the predetermined track area reaches a predetermined value.

2. A system as recited in claim 1 wherein said RF transmitting means includes:

RF generating means for generating the RF energy; and transmitting antenna means spaced from the track rail for directing RF energy from said RF generating means onto the track rail.

3. A system as recited in claim 1 wherein said RF transmitting means includes:

RF generating means for generating the RF energy; and transmitting antenna means, including a horn antenna, for directing RF energy from said RF generating means onto the track rail.

4. A system as recited in claim 1 wherein said RF detecting means includes:

receiving antenna means directed toward the predetermined track area for receiving RF energy radiating therefrom; and RF receiving means connected to said receiving antenna means for generating an output signal corresponding to the strength of the RF energy received by the said receiving antenna means.

5. A system as recited in claim 4 wherein said receiving antenna means includes a horn antenna directed toward the predetermined track area for receiving any RF energy therefrom.

6. A system as recited in claim 4 wherein said RF transmitting means includes:

RF generating means for generating the RF energy; and transmitting antenna means spaced from said track rail for directing RF energy from said RF generating means onto the track rail location.

7. A system as recited in claim 6 wherein said RF transmitting antenna means includes a horn antenna.

8. A system as recited in claim 6 wherein said transmitting antenna means directs RF energy along an axis oblique to the track rail and wherein said receiving antenna means has an axis oblique to the track rail.

9. A system as recited in claim 6 wherein said transmitting antenna means is directed along an axis that is about 45° to the track rail and the receiving antenna means is directed along aft axis that is about 90° to the track rail.

10. A method for detecting a track discontinuity in a predetermined track area comprising:

directing RF energy onto a proximately positioned track rail location remote from the predetermined track area whereby the track rail acts as a traveling wave antenna for conveying the RF energy to the predetermined track area;

detecting RF energy emanating from the predetermined track area; and generating an alarm when the detected RF energy reaches a predetermined value.

11. A method as recited in claim 10 wherein said RF directing step includes:

generating the RF energy; and coupling the RF energy to a transmitting antenna spaced from and aimed at the track rail location.

12. A method as recited in claim 10 wherein said RF directing step includes:

generating the RF energy; and coupling the RF energy to a transmitting horn antenna spaced from and aimed at the track rail location.

13. A method as recited in claim 10 wherein said RF detecting step includes:

receiving RF energy from the predetermined area of the track rail through a receiving antenna aimed at and spaced from the track rail; and generating an output signal corresponding to the strength of the received RF energy.

14. A method as recited in claim 10 wherein said RF detecting step includes:

receiving RF energy through a receiving horn antenna aimed at and spaced from the predetermined area of the track rail; and generating an output signal corresponding to the strength of the received RF energy.

15. A method as recited in claim 13 wherein said RF directing step includes:

generating the RF energy; and coupling the RF signal through a transmitting antenna aimed at and spaced from the track rail location thereby to couple RF energy onto the track rail as a travelling wave antenna.

16. A method as recited in claim 15 wherein said RF directing step includes coupling the RF energy through a transmitting horn antenna.

17. A method as recited in claim 16 wherein said RF coupling includes directing the RF energy to the track rail location along a transmitting axis oblique to the track rail and wherein said receiving step aims the antenna along a receiving axis oblique to the track rail.

18. A method as recited in claim 17 wherein the transmitting axis that is about 45° to the track rail and the receiving axis is about 90° to the track rail.

19. A system for detecting a track discontinuity in a predetermined track area comprising:

an RF transmitter means aimed to couple RF energy onto a proximately positioned track rail that is remote from the predetermined track area whereby the track rail acts as a traveling wave antenna for conveying RF energy to the predetermined track area;

an RF detector that receives RF energy emanating from the predetermined track area; and an alarm that responds to said RF detector when the RF energy from the predetermined track area exceeds a predetermined value.

20. A system as recited in claim 19 further including:

an RF generator;

a transmitting horn antenna connected to said RF generator, the RF generator and transmitting horn antenna serving as the transmitter means;

a receiving horn antenna aimed at and spaced from the predetermined track area; and an RF receiver connected to said receiving horn antenna and to said alarm, the receiving horn antenna and RF receiver serving as the RF detector.

* * * * *